US008727482B2

(12) United States Patent
Shimizu

(10) Patent No.: US 8,727,482 B2
(45) Date of Patent: May 20, 2014

(54) CAP OF LIQUID DISCHARGE HEAD AND LIQUID DISCHARGE APPARATUS

(75) Inventor: Kazutoshi Shimizu, Shimasuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/431,870

(22) Filed: Mar. 27, 2012

(65) Prior Publication Data

US 2012/0249671 A1 Oct. 4, 2012

(30) Foreign Application Priority Data

Mar. 29, 2011 (JP) ..... 2011-073554

(51) Int. Cl.
*B41J 2/165* (2006.01)

(52) U.S. Cl.
USPC ..... 347/29

(58) Field of Classification Search
USPC ..... 347/29
See application file for complete search history.

(56) References Cited

U.S. PATENT DOCUMENTS

| | | | | |
|---|---|---|---|---|
| 6,491,370 | B2 * | 12/2002 | Momose | 347/30 |
| 7,517,047 | B2 | 4/2009 | Kambe | |
| 2006/0066690 | A1 * | 3/2006 | Katayama | 347/71 |

FOREIGN PATENT DOCUMENTS

| | | |
|---|---|---|
| JP | 2005-138313 | 2/2005 |
| JP | 2006-175666 | 7/2006 |

* cited by examiner

*Primary Examiner* — Justin Seo
(74) *Attorney, Agent, or Firm* — Workman Nydegger

(57) ABSTRACT

The invention provides a cap of a liquid discharge head that discharges liquid from nozzle holes, can come in contact with a nozzle hole surface, and has an opposite surface opposite the nozzle hole surface, in which the opposite surface has protrusions.

12 Claims, 10 Drawing Sheets

CAP OF LIQUID DISCHARGE HEAD AND LIQUID DISCHARGE APPARATUS

BACKGROUND

1. Technical Field

The present invention relates to a cap of a liquid discharge head and a liquid discharge apparatus.

2. Related Art

An ink jet printer (hereafter, printer) equipped with a head discharging ink (liquid) from a nozzle hole has been known as a liquid discharge apparatus. In the printer, for example, when ink is not discharged for a long time from the nozzle hole, the ink solvent vaporizes from the nozzle hole and the nozzle is clogged.

A method has been proposed of disposing a liquid-permeable film in a concave cap to cover the nozzle hole surface of a head, with ink collected in a space of the cap including the film, when the head is not used for a long time, in order to prevent the nozzle from being clogged (for example, JP-A-2005-138313).

Further, a method has been known of bringing a substantially rectangular cap into close contact with the nozzle hole surface of a head to prevent the nozzle from being clogged. However, when the surface of the cap (being in close contact with the nozzle hole surface) is flat and the cap is pressed to the head to bring the cap in close contact with the head, there is no room for the deformable portion of the cap and the position of the cap is deviated from the head. Accordingly, the nozzle hole surface of the head is damaged.

SUMMARY

An advantage of some aspects of the invention is to reduce positional deviation of a cap with respect to a head.

According to an aspect of the invention, there is provided a liquid discharge apparatus including a liquid discharge head that discharges liquid from nozzle holes, and a cap having an opposite surface that can come in contact with a nozzle hole surface of the liquid discharge head, opposite the nozzle hole surface, and protrusions formed on the opposite surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

The following will be made clear from the description of the specification and the accompanying drawings.

That is, the invention provides a cap of a liquid discharge head that discharges liquid from nozzle holes, that can come in contact with a nozzle hole surface, and that has an opposite surface opposite the nozzle hole surface, in which the opposite surface has a protrusion.

According to the cap of the liquid discharge head, it is possible to reduce positional deviation of the cap with respect to the liquid discharge head.

The opposite surface forms a concave-convex shape in the cap of the liquid discharge head.

According to the cap of the liquid discharge head, it is possible to reduce positional deviation of the cap with respect to the liquid discharge head.

In the cap of the liquid discharge head, when the cap is in contact with the nozzle hole surface, the nozzle holes communicate with the atmosphere.

According to the cap of the liquid discharge head, it is possible to suppress an ink solvent from vaporizing from the nozzle holes.

In a liquid discharge apparatus including a circulating mechanism that circulates white ink discharged from the nozzle holes and stored in an ink storage unit communicating with the liquid discharge head and white ink in the liquid discharge head, the cap of the liquid discharge head can come in contact with the nozzle hole surface of the liquid discharge head.

According to the cap of the liquid discharge head, it is possible to make a nozzle hole-formed surface that is difficult to be damaged, even if the nozzle hole-formed surface is easily stained with white ink. Further, it is possible to prevent the white ink from leaking outside the cap while circulating the white ink.

In the cap of the liquid discharge head, the opposite surface has an edge wall that surrounds the nozzle holes when being in contact with the nozzle hole surface and forms a closed space between the opposite surface and the nozzle hole surface, and has a protrusion inside the edge wall.

According to the cap of the liquid discharge head, since the nozzle holes do not communicate with the atmosphere outside the edge wall, it is possible to suppress the ink solvent from vaporizing from the nozzle holes.

The invention provides a liquid discharge apparatus including a liquid discharge head that discharges liquid from nozzle holes and including a cap having an opposite surface that can come in contact with the nozzle hole surface of the liquid discharge head, that is opposite the nozzle hole surface, and that has protrusions formed on the opposite surface.

According to the liquid discharge apparatus, it is possible to reduce positional deviation of the cap with respect to the liquid discharge head.

Printing System

Hereinafter, assuming that a liquid discharge apparatus is an ink jet printer (hereafter, printer), an embodiment is described by exemplifying a printing system with a printer and a connected computer.

Figure 1A:
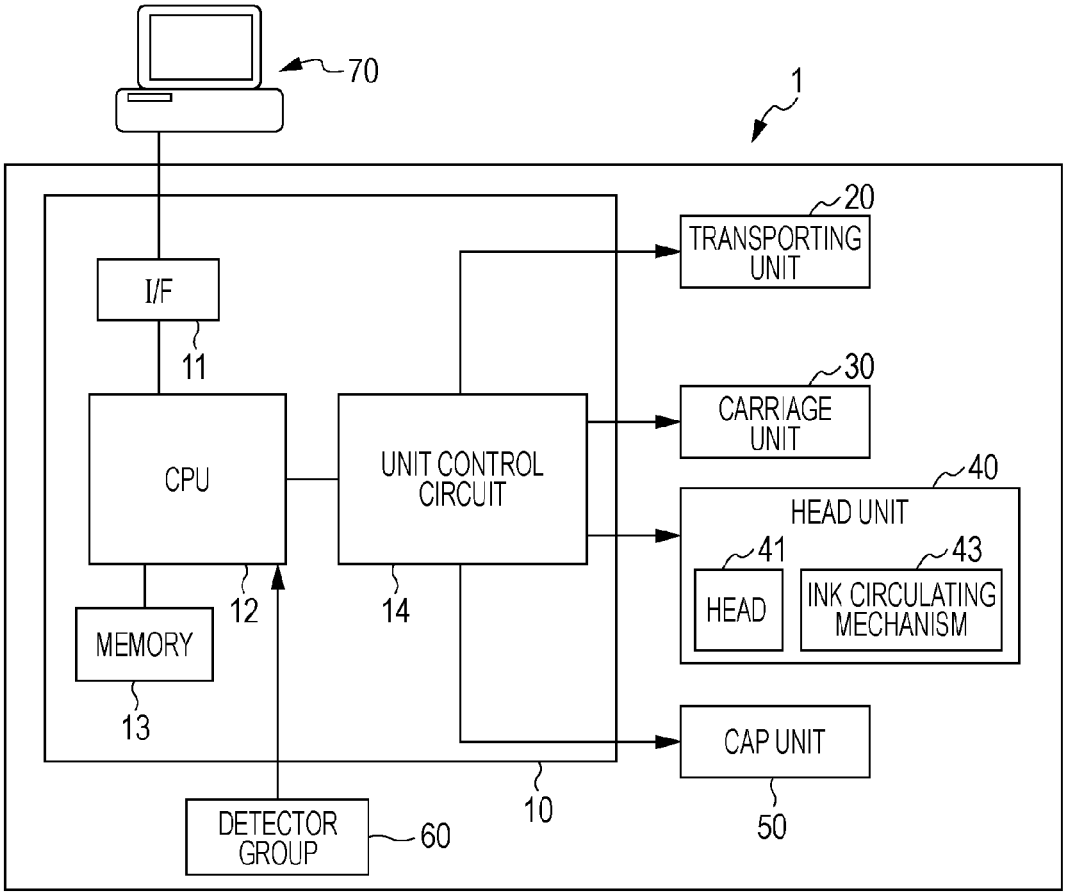
FIG. 1A is a block diagram showing the entire configuration of a printer and FIG. 1B is a schematic perspective view of the printer.
Figure 1B:
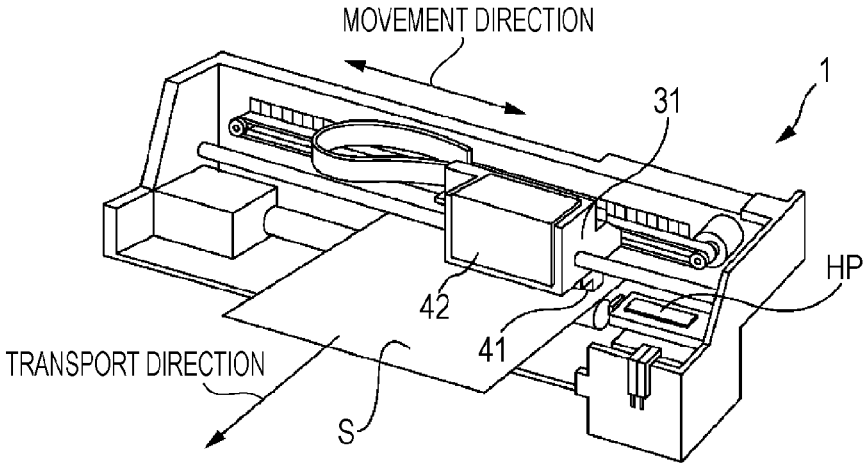

FIG. 1A is a block diagram showing the entire configuration of a printer 1 and FIG. 1B is a schematic perspective view of the printer 1. A computer 70 is connected with the printer 1 to facilitate communication therebetween. The computer 70 outputs print data to the printer 1 for printing an image by the printer 1.

A controller 10 is a control unit for controlling the printer 1. An interface unit 11 allows data to be communicated between a computer 70 and the printer 1. A CPU 12 is a calculation processing unit for controlling the entire printer 1. A memory 13 ensures a region for storing programs or a work region of the CPU 12. The CPU 12 controls the units by a unit control circuit 14. Further, a detector group 60 monitors the situation in the printer 1 and the controller 10 controls the units on the basis of the detected result.

A transporting unit 20 feeds a medium S (for example, sheet or fabric) to a printable position and transports the medium S by a predetermined transport amount in a transport direction in printing.

A carriage unit 30 moves a head 41 that discharges ink and a carriage 31 holding an ink cartridge 42 storing ink for each color in a movement direction crossing the transport direction.

Figure 2:
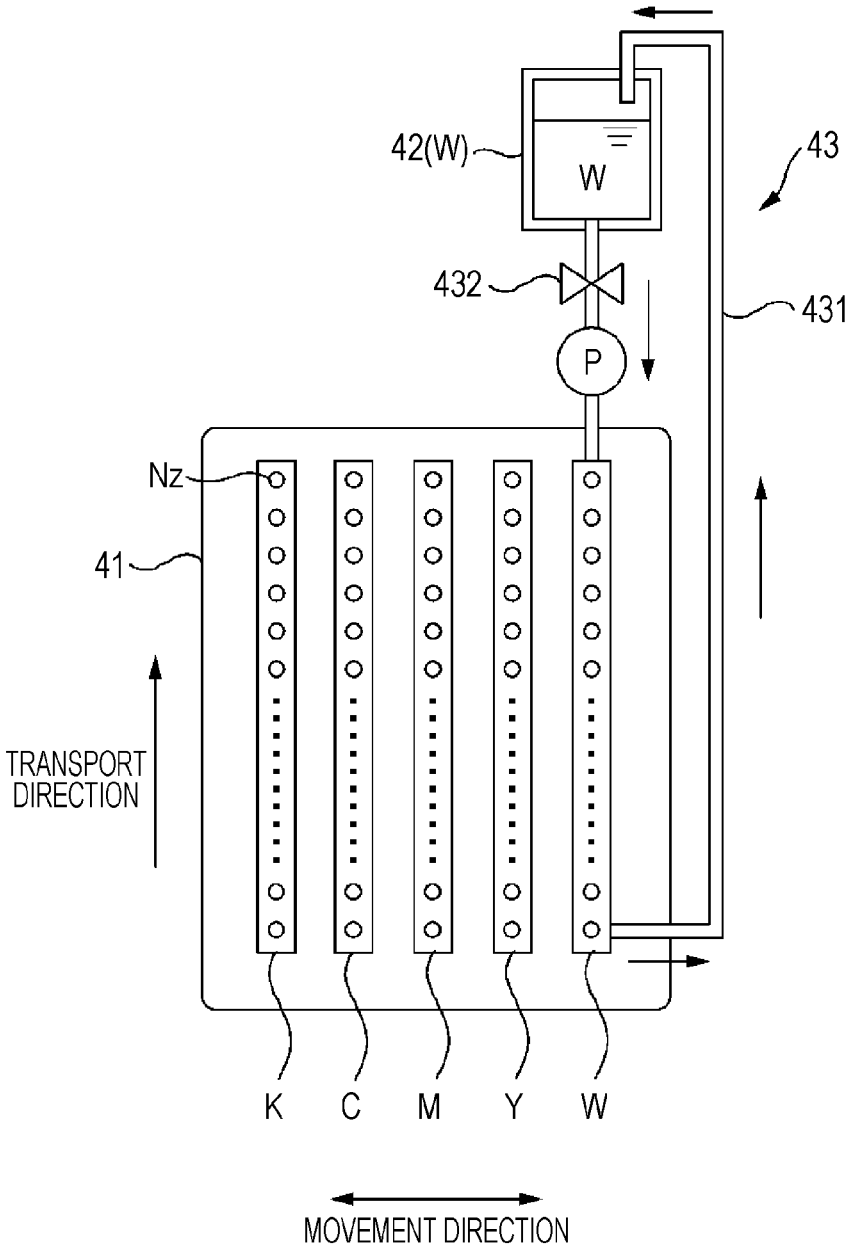
FIG. 2 is a view illustrating a head unit.

FIG. 2 is a view illustrating a head unit 40. The bottom of the head 41 is shown in the figure. The head unit 40 discharges ink to the medium S and includes a head 41 and an ink circulating mechanism 43. A plurality of nozzle holes Nz discharging the ink is formed on the bottom of the head 41 (corresponding to a liquid discharge head), as shown in FIG. 2. Accordingly, the bottom of the head 41 corresponds to a nozzle hole surface. The nozzles each communicate with an ink chamber (not shown) filled with ink and ink is supplied to the ink chambers from the ink cartridge 42. Further, discharging the ink from the nozzle holes Nz may be implemented by a piezo-method that discharges ink by expanding/contracting the ink chamber filled with ink by applying a voltage to a driving element (piezo-element) or a thermal method that discharges ink by using bubbles that are generated in the nozzles by a heating element.

Further, nozzle lines with the nozzle holes Nz for each color (arranged at predetermined intervals in the transport direction) are formed on the nozzle hole surface. The printer 1 of the embodiment can discharge five colors of ink. A black nozzle line K discharging black ink, a cyan nozzle line C discharging cyan ink, a magenta nozzle line M discharging magenta ink, a yellow nozzle line Y discharging yellow ink, and a white nozzle line W discharging white ink are formed on the nozzle hole surface.

The white ink contains, as a color material, a white pigment, such as titanium oxide, (for example, white ink described in JP-A-2002-38063). Accordingly, the concentration is easily made non-uniform due to deposition of the color material (white pigment), such that it is necessary to stir the white ink for use.

The printer 1 includes an ink circulating mechanism 43 (corresponding to the circulating mechanism) that circulates the white ink in a white ink cartridge 42(W) and the white ink in the head (for example, white ink in the ink chambers), the white ink cartridge 42(W) storing white ink and supplying the white ink to the head 41. The ink circulating mechanism 43 includes a circulating pipe 431, an on-off valve 432, and a pump P.

As the pump P is operated, for example, the white ink in the white ink cartridge 42(W) passes the on-off valve 432 and the pump P and is sent into the ink chambers of the nozzle in the white nozzle line W through the circulation pipe 431. The ink is then returned into the white ink cartridge 42(W). As the white ink is circulated, it is possible to stir the white ink in the white ink cartridge 42(W) and the white ink in the head 41, such that it is possible to uniformly disperse the white pigment in the white ink. Accordingly, it is possible to make the concentration of the white ink uniform and perform favorable printing.

Although only the ink circulating mechanism 43 for circulating the white ink is shown in FIG. 2, the invention is not limited thereto. For example, when the ink for the other four colors (CMYK) is pigment ink, the color materials (pigments) are easily deposited, as in the white ink. Therefore, it is preferable to equip the printer 1 with ink circulating mechanisms for each color.

A cap unit 50 includes a cap that comes in contact with the head 41, when the head 41 is moved to a home position HP (non-printing region) (the detail is described below).

In the printer 1, an image forming operation and a transporting operation are repeatedly performed. In the image forming operation, the ink is discharged from the head (which is moving in the movement direction) to the medium S. In the transporting operation, the medium S is transported in the transport direction. As a result, dots are formed by the next image forming operation at different positions from the positions of the dots formed by the previous image forming operation on the medium S, such that a 2D image is printed on the medium S.

Cap Unit 50

Figure 3:
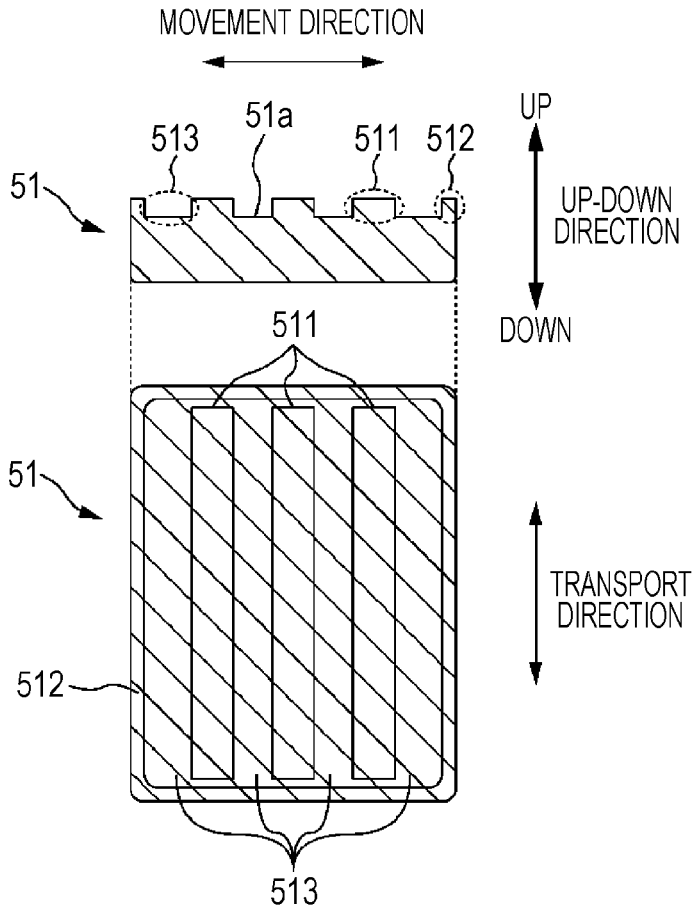
FIG. 3 is a view illustrating a cap according to an embodiment.
Figure 4A:
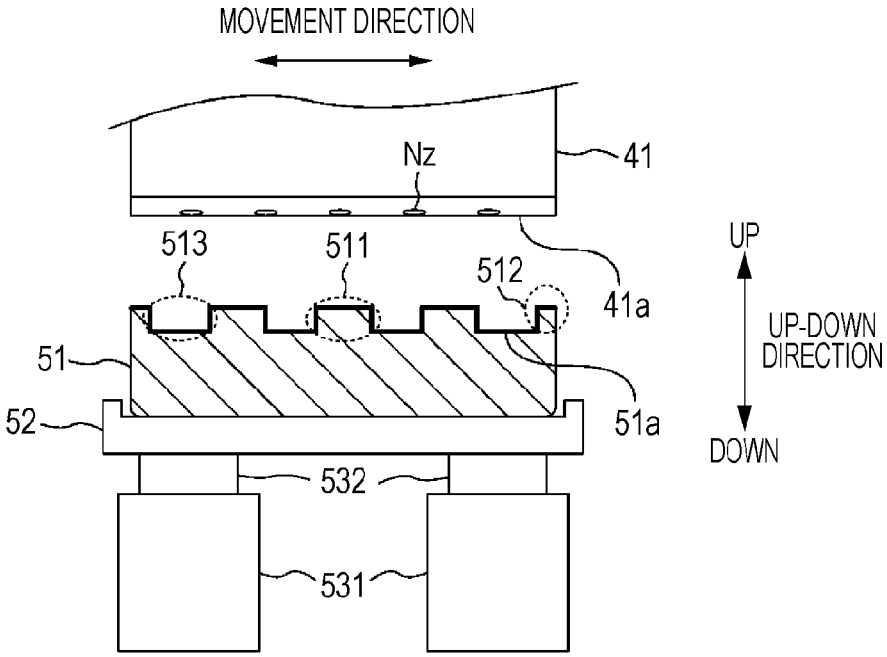
FIG. 4A is a view illustrating close contact between the cap and the head.
Figure 4B:
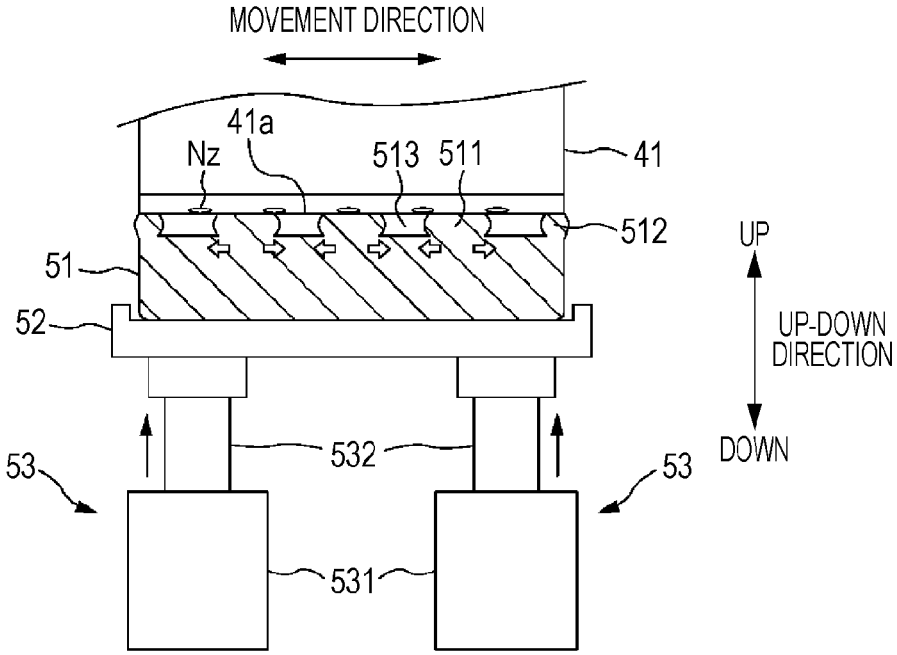
FIG. 4B is a view illustrating close contact between the cap and the head.
Figure 4C:
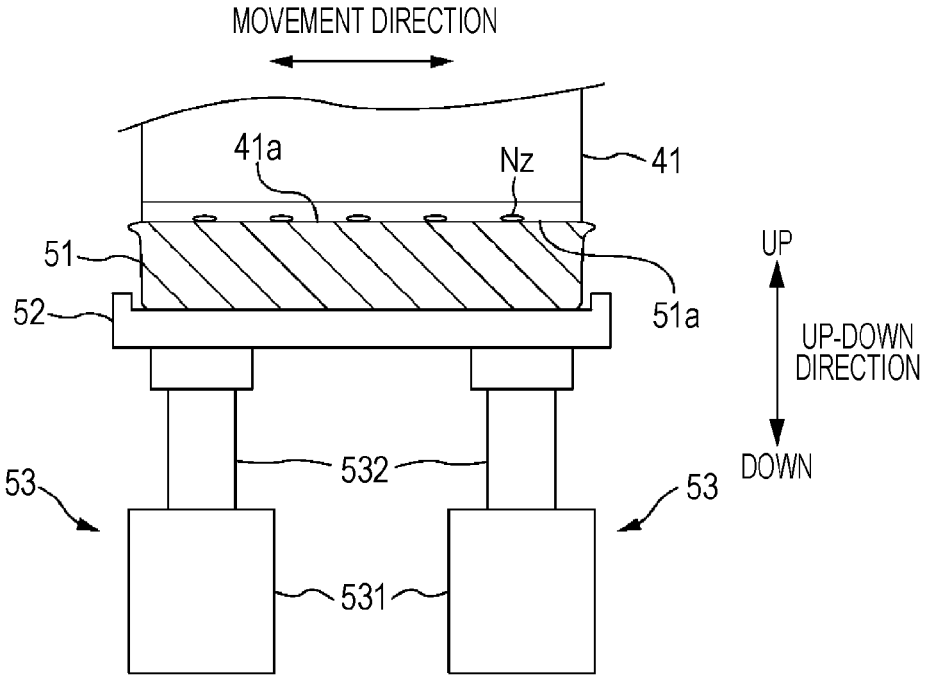
FIG. 4C is a view illustrating close contact between the cap and the head.

FIG. 3 is a view illustrating a cap 51 of the embodiment and FIGS. 4A to 4C are views illustrating when the cap 51 comes in close contact with the head 41 (nozzle hole surface 41*a*). The upper drawing in FIG. 3 is a cross-sectional view of the transport-directional center portion of the cap 51. The lower drawing in FIG. 3 is a view of the cap 51 seen from above. FIGS. 4A to 4C are cross-sectional views of the cap 51 or the head 41 seen in the transport direction.

The cap unit 50 includes the cap 51 being in close contact with the head 41, a holding table 52 holding the cap 51, and a cylinder 53 moving the cap 51 and the holding table 52 upward and downward. The cap 51 is made of an elastic material (for example, rubber or a thermoplastic elastomer). The cylinder 53 has a body portion 531 and a rod portion 532 that can vertically extend/retract with respect to the body portion 531, with the holding table 52 mounted on one end of the rod portion 532.

However, when the head 41 is not used for a long time, such as in non-printing or power-off conditions, that is, the ink is not discharged for a long time from the nozzle holes Nz. Thus, the ink solvent vaporizes from the nozzle holes Nz and thickens, or foreign substances stick to the nozzle holes Nz. Accordingly, the nozzles are clogged and the ink is not discharged when the ink is supposed to be discharged from the nozzle holes Nz, such that the image quality of the image is deteriorated.

The controller 10 of the printer 1 controls the carriage 31 to move the head 41 to the home position HP, when the head 41 is not used for a short time, such as when there is no next print job or the power is off. As the head 41 is moved to the home position HP, as shown in FIG. 4A, the nozzle hole surface 41*a* of the head 41 and the top 51*a* of the cap 51 (the surface indicated by a heavy line in FIG. 4A) are vertically spaced with a gap, opposite each other.

Further, the controller 10 moves the cap 51 and the holding table 52 upward by extending the rod portion 532 of the cylinder 53 upward. Accordingly, the cap 51 comes in contact with the head 41 (the nozzle hole surface 41*a*), as shown in FIGS. 4B and 4C, because the position of the head 41 is vertically fixed. Further, as the rod portion 532 is further extended, the cap 51 is pressed to the head 41 and comes in close contact with the head 41. Therefore, it is possible to prevent nozzles from being clogged by the cap 51 covering the nozzle holes Nz. Further, when printing is restarted, the controller 10 separates the cap 51 from the head 41 by retracting down the rod portion 532 of the cylinder 53.

Cap 80 of Comparative Example

Figure 5A:
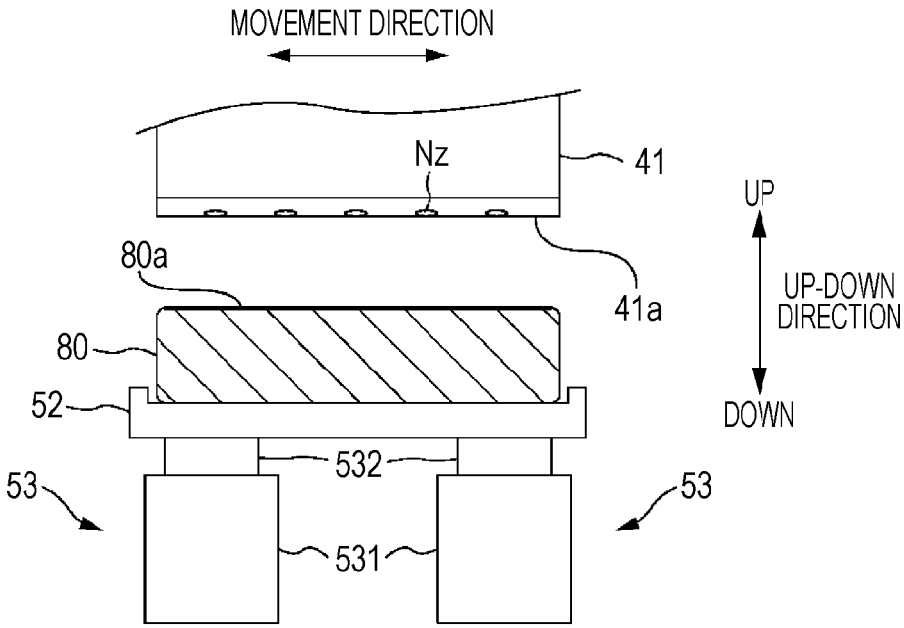
FIGS. 5A and 5B are views illustrating a cap according to a comparative example.
Figure 5B:
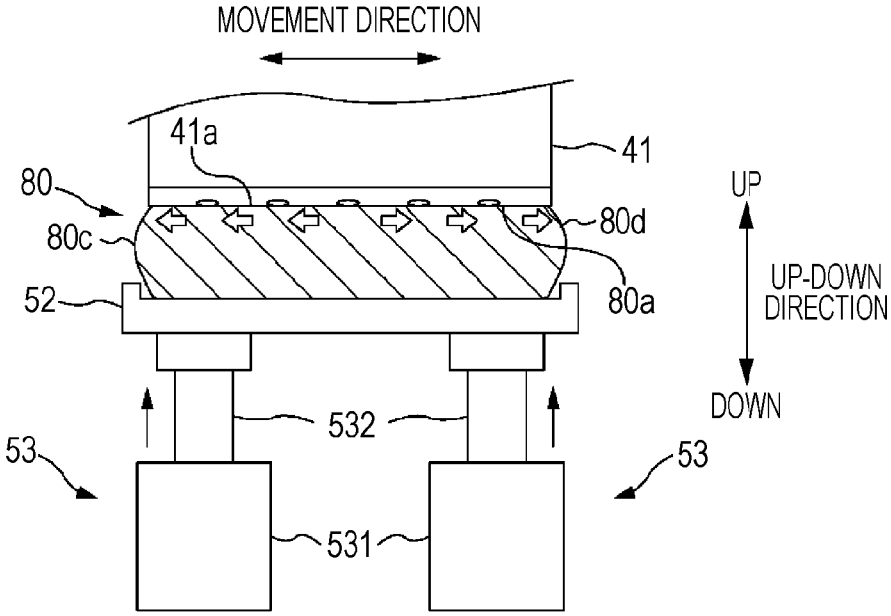

FIGS. 5A and 5B are views illustrating a cap 80 according to a comparative example. The cap 80 of the comparative example that is different from the cap 51 (FIG. 3) of the embodiment is described. The cap 80 of the comparative example is a rectangular member made of an elastic member. That is, the top 80*a* (surface indicated by a heavy line in FIG. 5A) of the cap 80 of the comparative example is flat.

As the cylinder 53 moves the cap 80 and the holding table 52 upwards, the top 80*a* of the cap 80 comes in close contact with the nozzle hole surface 41*a* of the head 41. Therefore, it is possible to prevent the nozzles from being clogged.

However, when the top 80*a* is flat, as in the cap 80 of the comparative example is flat, and when the cap 80 is pressed to the nozzle hole surface 41*a* of the head 41, there is no room for the deformable portion of the cap 80, because the head 41 and the cap 80 are in close contact. In particular, there is no room for deformation of the center portion of the top 80*a* of the cap 80.

Accordingly, as the cap 80 is pressed to the nozzle (nozzle hole surface 41*a*), a force exerted that moves the top 80*a* of the cap 80 in the surface direction along the nozzle hole surface 41*a*, toward the edge wall from the center portion of the top 80*a* of the cap 80 (that is, toward the outside of the nozzle hole surface 41*a*). This can be seen in that, as shown in FIG. 5B, as the cap 80 is pressed to the head 41 (nozzle hole surface 41*a*), the vertical sides 80*c* and 80*d* of the cap 80 are curved and a portion of the cap 80 protrudes outside the nozzle hole surface 41*a*.

Therefore, as the cap 80 of the comparative example is pressed to the head 41 (nozzle hole surface 41*a*), the position of the top 80*a* of the cap 80 with respect to the nozzle hole surface 41*a* of the head 41 moves from the initial contact position. That is, the top 80*a* of the cap 80 rubs the nozzle hole surface 41*a* of the head 41. Accordingly, the nozzle hole surface 41*a* is damaged.

In general, a water repellent film is disposed on the nozzle hole surface 41*a* to prevent ink from sticking and ensure straightness of the ink discharged from the nozzle holes Nz. Therefore, when the cap 80 rubs the nozzle hole surface 41*a*, the water repellent film on the nozzle hole surface 41*a* is worn. Accordingly, the nozzle hole surface 41*a* is stained with the ink or an adverse influence is exerted to the discharge of the ink from the nozzle holes Nz, such that the image quality of the image is deteriorated.

In particular, as in the printer 1 of the embodiment, when white ink containing a white pigment, such as a titanium oxide, is used, the cap 80 rubs the nozzle hole surface 41*a*, with the white ink intervening, such that the nozzle hole surface 41*a* (water repellent film) is easily worn. Further, similar to the white ink, even if the ink of the other colors (CMYK) are pigment ink, the nozzle hole surface 41*a* (water repellent film) is easily worn by the pigments.

It is an object of the cap 51 of the embodiment to reduce positional deviation of the cap 51 with respect to the head 41.

Cap 51 of the Embodiment

First, the cap 51 of the embodiment is described.

The cap 51 (FIG. 3) of the embodiment, similar to the cap 80 (FIGS. 5A and 5B), is a substantially rectangular member formed of an elastic member. However, the top 80*a* of the cap 80 of the comparative example is flat, whereas in the cap 51 (FIG. 3) of the embodiment, "protrusions 511" that protrude upward (to the head 41) are formed on the top 51*a* (the surface opposite the nozzle hole surface 41*a* of the head 41 opposite surface).

Further, the top 51*a* of the cap 51 has a substantially rectangular shape sized substantially the same as the nozzle hole surface 41*a*. Further, an "edge wall 512" (which is a protrusion continuing along the edge), protrudes upward (as do the protrusions 511), but at the edge of the top 51*a* of the cap 51. There are a pair of such edges in the movement direction, and a pair of such edges in the transport direction. The protrusions 511 are formed inside the edge wall 512. The embodiment exemplified the cap 51 in which three protrusions 511 (extending in the transport direction) are formed in parallel at predetermined intervals in the movement direction. However, the form, number, and arrangement of the protrusions 511 are not limited thereto. For example, a cap 51 (not shown) with protrusions 511 extending in the movement direction may be used.

Further, the vertical heights of the protrusions 511 and the edge wall 512 are the same and both ends of the protrusions 511 in the transport direction and the edge wall 512 are not connected. However, the invention is not limited thereto, and the heights of the protrusions 511 and the edge wall 512 may be different and the protrusions 511 and the edge wall 512 may be connected.

Further, on the top 51*a* of the cap 51, the portions other than the protrusions 511 and the edge wall 512 (that is, the portions vertically lower than the protrusions 511 and the edge wall 512) are called "recessions 513".

A plurality of protrusions 511 and a plurality of recessions 513 are alternately positioned in the movement direction inside the edge wall 512 on the top 51*a* of the cap 51 of the embodiment. Furthermore, the top 51*a* of the cap 51 has a concave-convex shape.

Next, a process of bringing the cap 51 into close contact with the head 41 in the embodiment is described.

As described above, the controller 10 of the printer 1 moves the head 41 to the home position HP when the head 41 is not used for a short time, and as shown in FIG. 4A, the nozzle hole surface 41*a* of the head 41 and the top 51*a* of the cap 51 face each other.

Further, the controller 10 moves the cap 51 and the holding table 52 upward by extending the rod portion 532 of the cylinder 53 upward. In this operation, as shown in FIG. 4B, the protrusions 511 and the edge wall 512 on the top 51*a* of the cap 51 come in contact with the nozzle hole surface 41*a* of the head 41.

In this process, all the nozzle holes Nz formed on the nozzle hole surface 41*a* are positioned inside the edge wall 512, with the edge wall 512 surrounding all the nozzle holes Nz. Meanwhile, the positional relationship between the protrusions 511 and the nozzle holes Nz is not prescribed. Therefore, the protrusions 511 may cover the nozzle holes Nz, or the recessions 513 may be opposite the nozzle holes Nz while the protrusions 511 do not cover the nozzle holes Nz.

Further, the edge wall 512 is a protrusion continuing along the edge of the top 51*a* of the cap 51. Therefore, as the edge wall 512 comes in contact with the nozzle hole surface 41*a*, closed spaces are formed inside the edge wall 512, that is, between the top 51*a* of the cap 51 and the nozzle hole surface 41*a*. That is, the recessions 513 become the closed spaces not communicating with the atmosphere outside the edge wall 512.

When the controller 10 further extends the rod 532 of the cylinder 53 upward, the cap 51 is pressed to the nozzle hole surface 41*a* of the head 41. That is, the cap 51 is interposed and compressed between the nozzle hole surface 41*a* of the head 41 and the holding table 52. In this operation, since the cap 51 is formed of an elastic member, the protrusions 511 being in contact with the nozzle hole surface 41*a* are deformed.

In this case, since the top 51*a* of the cap 51 of the embodiment has the concave-convex shape, the compressed and deformed protrusions 511 can escape to the recessions 513 that are adjacent in the movement direction. Accordingly, the force making the protrusions 511, which are compressed and deformed, deviate in the surface direction along the nozzle hole surface 41*a* is suppressed, such that the positional deviation of the protrusions 511 with respect to the nozzle hole surface 41*a* is suppressed.

Similarly, the edge wall 512, which is also compressed and deformed, can escape to the adjacent recessions 513 inside the edge wall 512 and to the outside of the edge wall 512 (the outside of the nozzle hole surface 41*a*). Accordingly, the force making the edge wall 512, which are compressed and deformed, deviate in the surface direction along the nozzle hole surface 41*a* is suppressed, such that the positional deviation of the edge wall 512 with respect to the nozzle hole surface 41*a* is suppressed.

Further, the controller 10, as shown in FIG. 4C, finally vertically compressing the cap 51 by extending the rod 532 of the cylinder 53 upward until the protrusions 511 and the edge wall 512 are crushed and the recessions 513 come in contact with the nozzle hole surface 41*a*. That is, the controller 10 brings the cap 51 into close contact with the head 41 such that the spaces between the recessions 513 and the nozzle hole surface 41*a* are removed and the top 51*a* of the cap 51 comes in close contact with the entire nozzle hole surface 41*a*.

As a result, all the nozzle holes Nz formed on the nozzle hole surface 41*a* cover the top 51*a* (protrusions 511 and recessions 513) of the cap 51, such that all the nozzle holes Nz do not communicate with the atmosphere. Therefore, it is possible to prevent the ink solvent from vaporizing from the nozzle holes Nz or foreign substances from sticking to the nozzle holes Nz, such that it is possible to the nozzles from being clogged. Accordingly, it is possible to perform printing favorably when restarting printing, even though the head 41 is not used for a long time.

Consequently, the cap 51 of the embodiment can independently cover the nozzle holes Nz, can come in contact with the nozzle hole surface 41*a* of the head 41 discharging ink from the nozzle holes Nz, and has the top 51*a* (opposite surface) opposite the nozzle hole surface 41*a*, in which the protrusions are formed on the top 51*a*.

As the protrusions 511 are formed on the top 51*a* of the cap 51, spaces are formed between the nozzle hole surface 41*a* and the cap 51 (the recessions 513 in the embodiment), when the protrusions 511 come in contact with the nozzle hole surface 41*a* of the head 41.

Therefore, even if the cap 51 (protrusions 511) are pressed to the nozzle hole surface 41*a* in order to bring the cap 51 into close contact with the head 41 (nozzle hole surface 41*a*), the compressed and deformed protrusions 511 can escape to the recessions 513. Accordingly, the force making the protrusions 511, which are compressed and deformed, deviate in the surface direction along the nozzle hole surface 41*a* is suppressed, such that it is possible to prevent the protrusions 511 from deviating from the positions where the protrusions 511 initially come in contact with the nozzle hole surface 41*a*. Similarly, since it is possible for the edge wall 512 to escape to the recessions 513 or the outside of the nozzle hole surface 41*a* when compressing and deforming the edge wall 512, it is possible to suppress the edge wall 512 from deviating from the initial contact position.

That is, according to the cap 51 of the embodiment, it is possible to reduce positional deviation of the cap 51 with respect to the head 41 when bringing the cap 51 into close contact with the head 41. As a result, it is possible to suppress the cap 51 from damaging the nozzle hole surface 41*a* of the head 41, such that, for example, it is possible to suppress wearing of a water repellent film on the nozzle hole surface 41*a*. In this case, ink does not stick to the nozzle hole surface 41*a*, such that it is possible to ensure straightness of the ink discharged from the nozzle holes Nz.

Further, in the cap 51 of the embodiment, since the protrusions 511 are formed on the top 51*a*, the top 51*a* has a concave-convex shape. When the number of the protrusions 511 on the top 51*a* of the cap 51 increases, the number of the recessions 513 correspondingly increases. Accordingly, the distances from the protrusions 511 (for example, the center portions of the protrusions 511) to the recessions 513 decrease, such that the compressed and deformed protrusions 511 easily escape to the recessions 513. In this case, since the force making the protrusions 511 deviate in the surface direction along the nozzle hole surface 41*a* is further suppressed, it is possible to further reduce the positional deviation of the cap 51 with respect to the head 41.

Further, in the embodiment, finally, a shown in FIG. 4C, the protrusions 511 and the edge wall 512 are crushed, such that the cap 51 is compressed until the recessions 513 come in contact with the nozzle hole surface 41*a*. Therefore, the nozzle holes Nz do not communicate with the atmosphere, when the cap 51 is in contact with the nozzle hole surface 41*a*. As a result, it is possible to further suppress the ink solvent from vaporizing from the nozzle holes Nz, such that it is possible to suppress the nozzles from being clogged.

Further, it is preferable to adjust the hardness of the cap 51 or the vertical heights of the protrusions 511 and the edge wall 512 and the force (pressure) for pressing up the cap 51 with the cylinder 53, in order to crush the protrusions 511 and the edge wall 512 and bring the recessions 513 into close contact with the nozzle hole surface 41*a*, with the nozzle holes Nz not communicating with the atmosphere.

Further, the edge wall 512 (that surrounds the nozzle holes Nz and forms the closed spaces between the top 51*a* of the cap 51 and the nozzle hole surface 41*a* when being in contact with the nozzle hole surface 41*a*) is formed at the edge of the top 51*a* of the cap 51 of the embodiment. Further, the protrusions 511 are formed inside the edge wall 512.

As the edge wall 512 of the cap 51 is in close contact with the nozzle hole surface 41*a*, the junction of the cap 51 and the nozzle hole surface 41*a* is sealed and the spaces inside the edge wall 512, which are the spaces between the top 51*a* of the cap 51 and the nozzle hole surface 41*a*, become closed spaces. In this state, the inside of the edge wall 512 (that is, the recessions 513) does not communicate with the atmosphere outside the edge wall 512. Further, since the nozzle holes Nz are positioned inside the edge wall 512, as the edge wall 512 comes in contact with the nozzle hole surface 41*a*, the nozzle holes Nz also do not communicate with the atmosphere outside the edge wall 512.

Accordingly, even if the protrusions 511 or the edge wall 512 is not completely crushed and the recessions 513 are not in complete contact with the nozzle hole surface 41*a*, the nozzle holes Nz do not communicate with the atmosphere outside the edge wall 512 by the edge wall 512, such that it is possible to suppress the ink solvent from vaporizing from the nozzle holes Nz.

Further, since the protrusions 511 are formed inside the edge wall 512, stability increases when the cap 51 (protrusions 511 and the edge wall 512) is in contact with the nozzle hole surface 41*a* of the head 41, such that it is possible to reduce positional deviation of the cap 51 with respect to the head 41.

Further, the printer 1 of the embodiment is equipped with the ink circulating mechanism 43 that uses white ink (discharges white ink from the nozzle holes Nz) and circulates the white ink in the white ink cartridge 42 (W) (ink storage unit storing white ink and communicating with the head 41) and the white ink in the head 41.

When white ink containing a white pigment, such as titanium oxide, is used, the nozzle hole surface 41*a* is easily damaged by the positional deviation of the cap 51 with respect to the head 41. Even though the white ink is used and the nozzle hole surface 41*a* is easily damaged, it is possible to prevent the nozzle hole surface 41*a* from being easily damaged, by using the cap 51 of the embodiment which reduces the positional deviation of the cap 51 with respect to the head 41. Further, even if ink of other colors (CMYK) is the pigment ink (not just the white ink), the nozzle hole surface 41*a* is easily damaged by the pigment, such that the cap 51 of the embodiment is effective.

Further, similarly, when the head 41 is not used for a long time, it is necessary to bring the cap 51 into close contact with the head 41 even though white ink is circulated by the ink circulating mechanism 43. In this case, as shown in FIG. 4C, the cap 51 is compressed until the recessions 513 also come in contact with the nozzle hole surface 41*a*, with the nozzle holes Nz not communicating with the atmosphere, and the cap 51 having the edge wall 512 is used, such that it is possible to prevent the white ink from leaking out from the cap 51 while circulating the white ink. Therefore, it is possible to prevent the inside of the printer 1 from being stained with the ink. Further, even if ink of other colors (CMYK) is the pigment ink (not just, the white ink), and the pigment ink is circulated by the ink circulating mechanism, it may be possible to prevent the nozzle holes Nz from communicating with the atmosphere or to use the cap 51 having the edge wall 512.

Further, when ink with high viscosity (for example: ultraviolet curable ink) is used, the viscosity of the ink discharged from the nozzle holes Nz is adjusted by adjusting temperature of the ink with a heater. Even though the viscosity of the ink is adjusted, the cap 51 may be brought into close contact with the head 41. In this case, the nozzle holes Nz do not communicate with the atmosphere, such that it is possible to prevent the ink from leaking out from the cap 51 by using the cap 51 having the edge wall 512.

MODIFIED EXAMPLE 1

Figure 6:
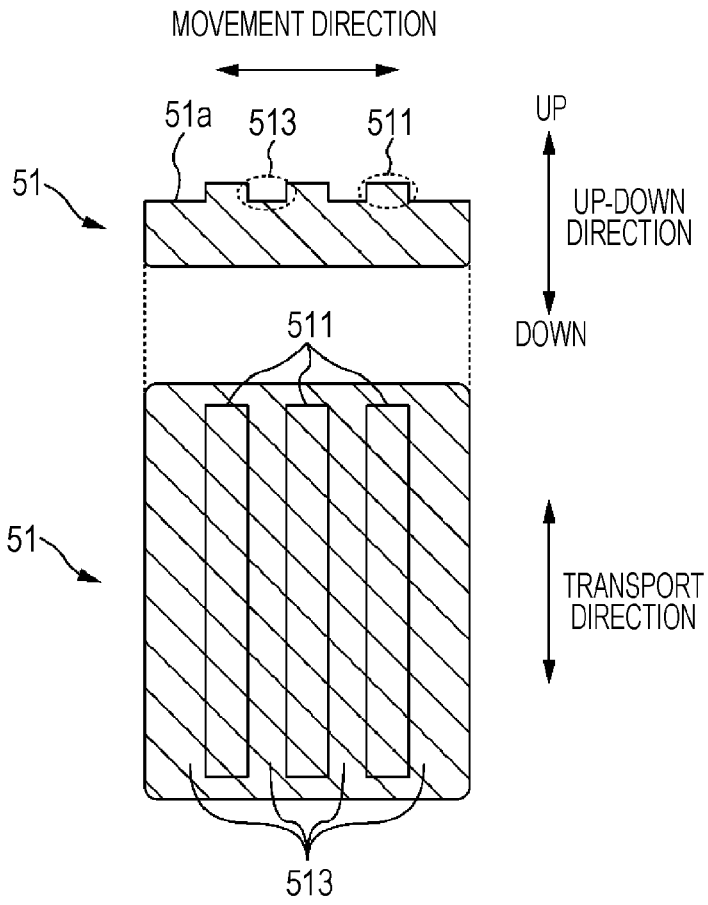
FIG. 6 is a view illustrating a cap according to Modified Example 1.

FIG. 6 is a view illustrating a cap 51 according to Modified Example 1. Although the edge wall 512 protruding upward along the edge of the top 51*a* of the cap 51 is formed at the cap 51 (FIG. 3) in the embodiment described above, the invention is not limited thereto. Protrusions 511 extending in the transport direction are formed on the top 51*a* of the cap 51 of Modified Example 1, but the edge wall 512 is not formed at the edge of the top 51*a*.

Similarly, in the cap 51 of Modified Example 1, the protrusions 511, which are compressed and deformed, can escape to the adjacent recessions 513, when the cap 51 is brought into close contact with the nozzle hole surface 41*a* of the head 41, such that it is possible to reduce positional deviation of the cap 51 with respect to the head 41.

Further, the protrusions 511 are crushed and the cap 51 is compressed until the recessions 513 come in close contact with the nozzle hole surface 41*a*, such that the nozzle holes Nz do not communicate with the atmosphere. Accordingly, it is possible to suppress the ink solvent from vaporizing from the nozzle holes Nz, even though the edge wall 512 is not formed on the top of the cap 51.

MODIFIED EXAMPLE 2

Figure 7A:
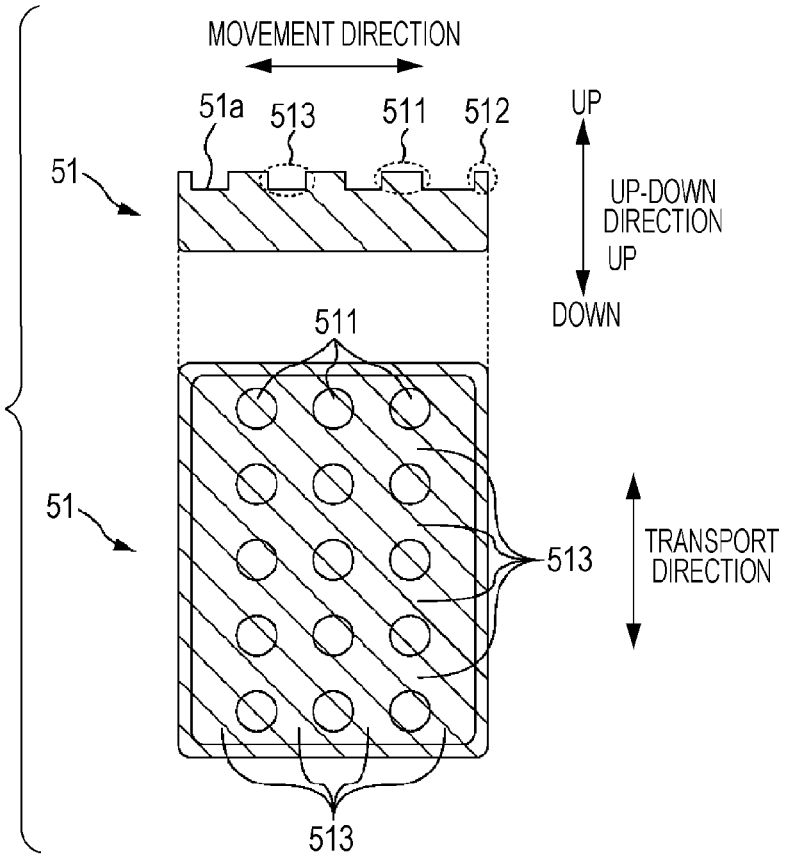
FIGS. 7A and 7B are views illustrating a cap according to Modified Example 2.
Figure 7B:
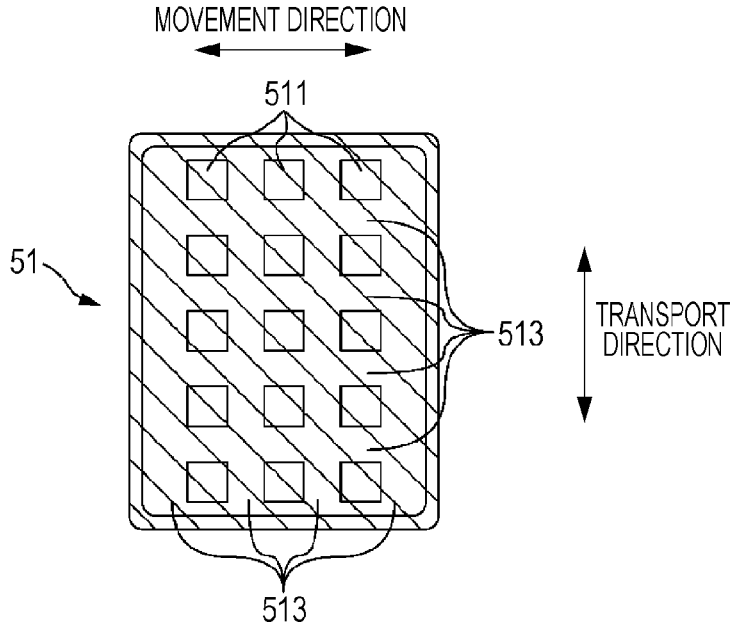

FIGS. 7A and 7B are views illustrating a cap 51 according to Modified Example 2. Although the protrusions 511 formed on the top 51*a* of the cap 51 extend in the transport direction in the cap 51 (FIG. 3) of the embodiment described above, the invention is not limited thereto. Protrusions 511 that are short in the transport direction are formed at predetermined intervals in the movement direction and the transport direction on the top 51*a* of the cap 51 of Modified Example 2.

Cylindrical protrusions 511 are formed on the top 51*a* of the cap 51 of FIG. 7A and parallelepiped protrusions 511 are formed on the top 51*a* of the cap 51 of FIG. 7B. Further, an edge wall 512 may or may not be formed on the top 51*a* of the cap 51.

Recessions 513 are formed around the protrusions 511 in the cap 51 of Modified Example 2. Therefore, the protrusions 511, which are compressed and deformed, can escape to both the recessions 513 that are adjacent in the movement direction and the recessions 513 that are adjacent in the transport direction, when the cap 51 is brought into close contact with the nozzle hole surface 41*a* of the head 41, such that it is possible to reduce positional deviation of the cap 51 with respect to the head 41.

MODIFIED EXAMPLE 3

Figure 8:
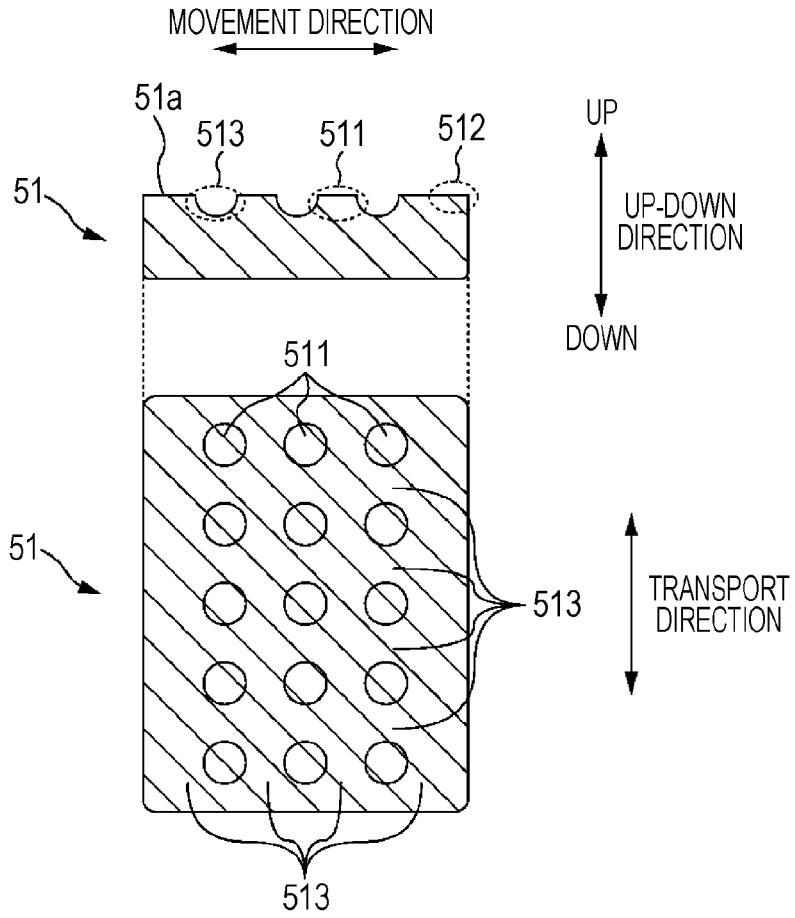
FIG. 8 is a view illustrating a cap according to Modified Example 3.

FIG. 8 is a view illustrating a cap 51 according to Modified Example 3. Since the parallelepiped protrusions 511 extending in the transport direction are formed in the cap 51 (FIG. 3) of the embodiment described above, the recessions 513 correspondingly extend in the transport direction and the cross-sections of the recessions 513 are rectangular shapes when seen in the transport direction, but the invention is not limited thereto. Semispherical protrusions 513 are formed at predetermined intervals in the movement direction and the transport direction on the top 51*a* of the cap 51 of Modified Example 3. That is, the cap 51 of Modified Example 3 has a shape where semicircular grooves are formed on the flat top of the cap 80 (FIG. 5) of the comparative example.

In this case, the periphery of the recessions 513 becomes the protrusions 511 and the edge wall 512, on the top 51*a* of the cap 51. Therefore, similarly, in the cap 51 of Modified Example 3, the protrusions 511, which are compressed and deformed, can escape to the recessions 513, when the cap 51 is brought into close contact with the nozzle hole surface 41*a* of the head 41, such that it is possible to reduce positional deviation of the cap 51 with respect to the head 41.

Further, the portions (other than the recessions 513 on the top 51*a* of the cap 51 are in contact with the nozzle hole surface 41*a* of the head 41, such that the nozzle holes Nz do not communicate with the atmosphere outside the cap 51. Accordingly, it is possible to suppress the ink solvent from vaporizing from the nozzle holes Nz, even if the recessions 513 are not completely in contact with the nozzle hole surface 41*a*.

MODIFIED EXAMPLE 4

Figure 9A:
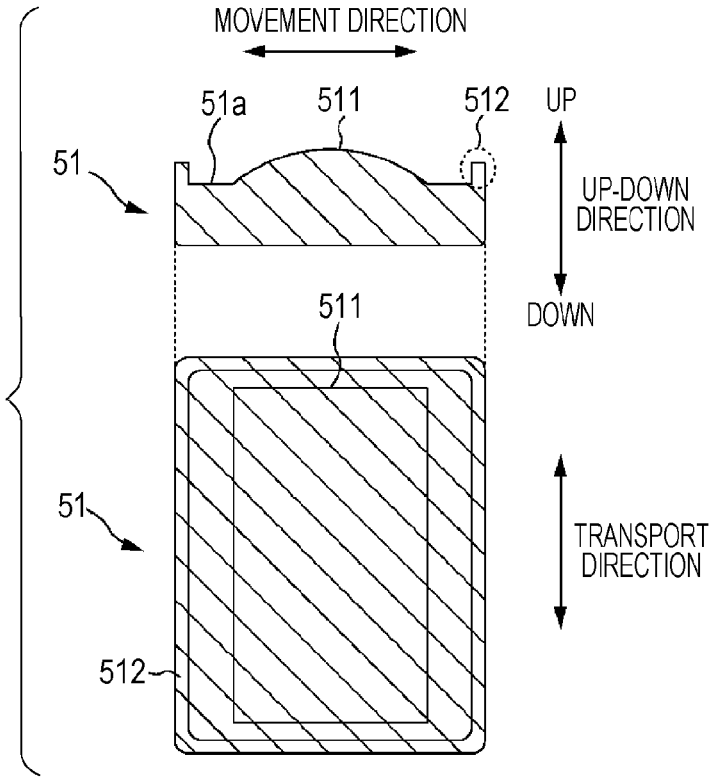
FIGS. 9A and 9B are views illustrating a cap according to Modified Example 4.
Figure 9B:
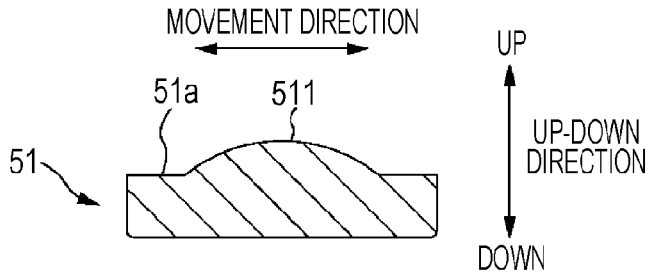
Figure 10:
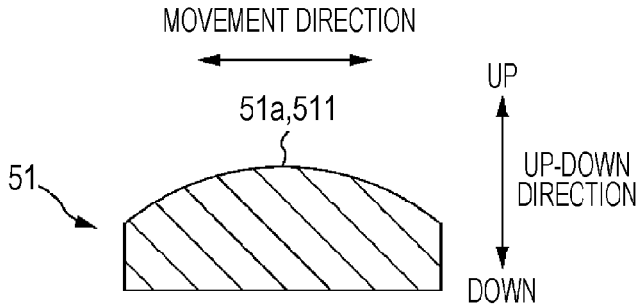
FIG. 10 is a view illustrating a cap according to Modified Example 4.

FIGS. 9A, 9B, and 10 are views illustrating a cap 51 according to Modified Example 4. Although a plurality of protrusions 511 is formed on the top 51*a*, in the cap 51 (FIG. 3) of the embodiment described above, the invention is not limited thereto.

Only one protrusion 511 extending in the transport direction is formed on the top 51*a* of the cap 51 of Modified Example 4. A mountain-shaped protrusion 511 protruding upward across the center portion in the movement direction is formed in FIGS. 9A and 9B. However, the invention is not limited thereto and only one protrusion having a parallelepiped shape may be formed. Further, as shown in FIG. 9A, an edge wall 512 may be formed at the edge of the top 51*a* of the cap 51, or, as shown in FIG. 9B, an edge wall 512 may not be formed on the top 51*a* of the cap 51.

Further, as shown in FIG. 10, a cap having a protrusion 511 bending upward across the center portion from both ends in the movement direction of the top 51*a* of the cap 51, that is, a cap having the top 51*a* of the cap 51 which is formed in a mountain shape overall may be used.

Similarly, in the cap 51 of Modified Example 4, a space is formed between the nozzle hole surface 41*a* and the cap 51, when the protrusion 511 is in contact with the nozzle hole surface 41*a* of the head 41. Accordingly, the protrusion 511, which are compressed and deformed, can escape from the space, such that it is possible to reduce positional deviation of the cap 51 with respect to the head 41.

Other Embodiments

Although the embodiment described above mainly describes a liquid discharge apparatus, it also includes a liquid discharge head and a cap. Further, the embodiment described above is provided for easy understanding of the invention and not for limiting construction of the invention. The invention may be changed and modified without departing from the spirit and the equivalents are included in the invention.

Printer

The embodiment described above exemplifies the printer 1 that repeats the operation of discharging ink from the head moving in the movement direction and the operation of transporting the medium in the transport direction, but the invention is not limited thereto. For example, a printer (so-called a line head printer) that discharges ink to a medium from a plurality of heads fixed and aligned in the width direction, when the medium passes across the paper width direction, under the head, may be used. Further, for example, a printer that forms an image by repeating an operation of forming an image while moving a head in the medium transport direction and an operation of moving the head in the paper width direction, onto continuous sheets transported to a print area, and then transport the non-recorded medium portion to the print area may be used.

Liquid Discharge Apparatus

Although an ink jet printer is exemplified as a liquid discharge apparatus in the embodiment described above, the invention is not limited thereto. The liquid discharge apparatus can be applied to various industrial apparatus and the invention may be applied to, for example, a printing apparatus printing marks on a fabric, an apparatus for manufacturing a color filter, or an apparatus for manufacturing a display, such as an organic EL display.

The entire disclosure of Japanese Patent Application No. 2011-73554, filed Mar. 29, 2011 is expressly incorporated by reference herein.

What is claimed is:

1. A cap of a liquid discharge head, comprising:

an opposite surface that comes in contact with a nozzle hole surface and is opposite to a nozzle hole surface of the liquid discharge head that discharges liquid from a plurality of nozzle holes, wherein the opposite surface has a first surface and a second surface under the first surface in the direction perpendicular to the opposite surface and wherein a position of the first surface and the second surface are substantially the same when the opposite surface comes in contact with the nozzle hole surface, wherein the first surface comprises the tops of columns protruding from the second surface; and wherein each nozzle of the plurality of nozzle holes does not independently communicate with atmosphere when the cap comes into contact with the nozzle hole surface.

2. The cap of a liquid discharge head according to claim 1, wherein the first surface is opposite at least one of the nozzle holes.

3. The cap of a liquid discharge head according to claim 1, wherein the second surface is opposite at least one of the nozzle holes.

4. The cap of a liquid discharge head according to claim 1, wherein the position of the first surface in the direction perpendicular to the opposite surface and the position of the second surface in the direction perpendicular to the opposite surface are substantially the same when the cap is in contact with the nozzle hole surface.

5. The cap of a liquid discharge head according to claim 1, wherein white ink from the plurality of nozzle holes is discharged, the liquid discharge head further comprising:

a circulating mechanism that circulates the white ink in the liquid discharge head.

6. The cap of a liquid discharge head according to claim 1, comprising an edge wall that surrounds the plurality of nozzle holes and forms closed spaces between the opposite surface and the nozzle hole surface, when the cap is in contact with the nozzle hole surface.

7. A liquid discharge apparatus comprising a cap, the cap comprising:

an opposite surface that comes in contact with a nozzle hole surface and is opposite to a nozzle hole surface of the liquid discharge head that discharges liquid from a plurality of nozzle holes, wherein the opposite surface has a first surface and a second surface under the first surface in the direction perpendicular to the opposite surface and wherein a position of the first surface and the second surface are substantially the same when the opposite surface comes in contact with the nozzle hole surface, wherein the first surface comprises the tops of columns protruding from the second surface; and wherein each nozzle of the plurality of nozzle holes does not independently communicate with atmosphere when the cap comes into contact with the nozzle hole surface.

8. The liquid discharge apparatus according to claim 7, wherein the first surface is opposite at least one of the nozzle holes.

9. The liquid discharge apparatus according to claim 7, wherein the second surface is opposite at least one of the nozzle holes.

10. The liquid discharge apparatus according to claim 7, wherein the position of the first surface in the direction perpendicular to the opposite surface and the position of the second surface in the direction perpendicular to the opposite surface are substantially the same, when the cap is in contact with the nozzle hole surface.

11. The liquid discharge apparatus according to claim 7, further comprising:

a circulating mechanism that circulates a white ink in the liquid discharge head, wherein the white ink is discharged from the plurality of nozzle holes.

12. The liquid discharge apparatus according to claim 7, wherein the cap comprises an edge wall that surrounds the plurality of nozzle holes and forms closed spaces between the opposite surface and the nozzle hole surface, when the cap is in contact with the nozzle hole surface.

* * * * *